United States Patent [19]

Laurent

[11] 4,035,618

[45] July 12, 1977

[54] MONITOR FOR KNITTING MACHINES

[75] Inventor: Maurice Laurent, Tassin La Demi-Lune, France

[73] Assignee: Rhone-Poulenc-Textile, Paris, France

[21] Appl. No.: 652,246

[22] Filed: Jan. 26, 1976

[30] Foreign Application Priority Data

Jan. 28, 1975 France ..... 75.02999

[51] Int. Cl.[2] ..... G07C 3/10

[52] U.S. Cl. ..... 235/92 PD; 66/1 R; 235/92 R; 235/92 DN

[58] Field of Search ..... 235/92 PD, 92 TF, 92 DN, 235/92 FQ; 66/1 R, 125 R

[56] References Cited

U.S. PATENT DOCUMENTS

| | | | |
|---|---|---|---|
| 2,851,596 | 9/1958 | Hilton | 235/92 TF |
| 3,099,142 | 7/1963 | Mishcon | 66/1 R |
| 3,539,782 | 11/1970 | Upshur | 235/92 PD |
| 3,727,033 | 4/1973 | Bassist | 235/92 PD |
| 3,790,761 | 2/1974 | Crabtree | 235/92 PD |

*Primary Examiner*—Joseph M. Thesz
*Attorney, Agent, or Firm*—Sherman & Shalloway

[57] ABSTRACT

A portable monitor unit for knitting machines and particularly suitable for circular knitting machines including a yarn speed sensor pulsing a numeral display counter via a gate, a needle detector controlling the gate via a settable counter, a frequency meter, and a switch for selectively engaging the signals of the yarn sensor, needle detector and frequency meter to display yarn length per needle stitch, yarn length per unit time, and rpm of the knitting machine.

5 Claims, 1 Drawing Figure

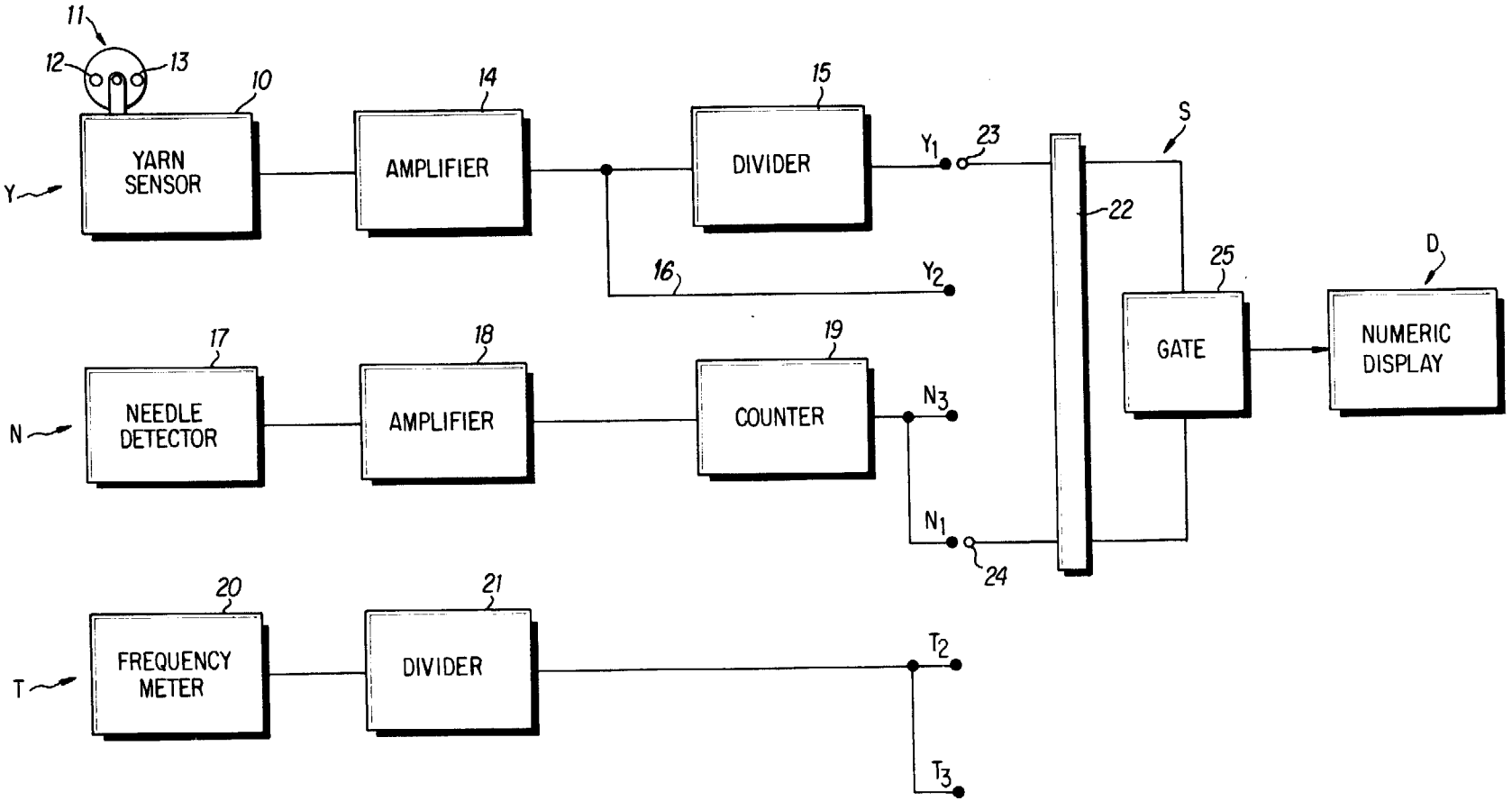
NUMERIC DISPLAY
D
GATE
25
S
22
23
24
Y1
Y2
N3
N1
T2
T3
DIVIDER
15
16
COUNTER
19
AMPLIFIER
14
AMPLIFIER
18
DIVIDER
21
YARN SENSOR
10
NEEDLE DETECTOR
17
FREQUENCY METER
20
11
12
13
Y
N
T

MONITOR FOR KNITTING MACHINES

BACKGROUND OF THE INVENTION

The present invention relates to the monitoring of knitting units and is concerned, more particularly, with the sensing and comparison of multiple parameters in circular knitting units.

BRIEF DESCRIPTION OF THE PRIOR ART

Various procedures have been employed in the monitoring of knitting units to an indication of the nature of the actual knit with regard to a desired norm.

For example, a given knitting operation will consume a predetermined length of yarn in a preselected number of stitches per unit length of the knitted product. Deviations from these norms or parameters produce variations in the quality of the knit and, therefore, provide sensible or measurable bases for monitoring the quality of the knit.

This sensing or measuring has been accomplished in several ways which, however, have been complex and typically have required permanent association of the sensors with the knitting unit. Therefore, prior units have greatly increased the cost of multiple-unit knitting installation and have added undesirable complexity and volume or bulk in such installations. These problms are particularlly evident in circular-knitting installations.

The prior monitoring procedures have involved a variety of measuring steps for determining the yarn input and the stitch count. Tachometers have been used to indicate the speed of the knitter for auging the stitch rate. Stroboscopes have been conveniently employed for circular knitters.

The yarn rate has been sensed by tachometers or by measured and marked lengths of yarn. One system employs electrostatic marking of the yarn, at spaced points along its length.

The quality of the knit may then be determined in terms of the length of yark consumed in forming a predetermined number of stitches and in comparison with the desired norms.

French Pat. No. 2,038,483 discloses a yarn-monitoring system including a yarn feeder having a rotating disc with alternating dark and light sections, and a reader for transforming the resultant light pulses into electrical pulses. A microcontact in engagement with a rotating element of the machine delivers a simple pulse per revolution, which pulses are accumulated in a counter serving a function selector. The feeder signals are amplified and formed and delivered via an integrating meter to an intermediate unit connectable with the counter. A control circuit is provided in parallel with the intermediate element to control the cycling of pulses from the feeder.

This yarn-measuring system has proven effective, with an accuracy involving only a 1% margin of error. However, such systems involve a great deal of elaboration of the intallation since elements functional to the sensor system must be incorporated in each unit. Also, additional sensing means are necessary to achieve complete monitoring of the operation.

Therefore, prior knitting monitors have not been found to be entirely satisfactory, particularly for circular knitting installations.

SUMMARY OF THE INVENTION

In general, the preferred form of the present invention comprises a portable monitoring unit including a yarn sensor for delivering a fixed number of yarn pulses per unit of yarn length, a gate for receiving the yarn pulses for delivery to a numeral display, a needle detector for delivering needle pulses to a counter, and switch means for connecting the yarn sensor and the needle detector to the gate. Preferably, the monitoring unit includes a frequency meter and the switch means includes means for selectively delivering the yarn pulses and the needle pulses through the gate for an interval set by the frequency meter.

OBJECTS OF THE INVENTION

It is an object of the present invention to provide a portable monitor unit for knitting machines.

It is another object of the present invention to provide a portable monitor unit for circular knitting machines which is capable of use with a plurality of machines without requiring complication of the structure of the individual machines.

It is a further object of the present invention to provide a portable monitor unit for circular knitting machines which is capable of indicating the relationship between the number of knit stitches and the length of yarn consumed in the stitches.

It is another object of the present invention to provide a portable monitor unit for circular knitting machines which is capable of indicating the rate of yarn consumption of the machine.

It is another object of the present invention to provide a portable monitor unit for circular knitting machines which is capable of indicating the rotational speed of the machine.

Another object of the present invention is the provisions of a portable monitor unit for circular knitting machines which is capable of indicating, selectivley, the linear yarn consumption for a selected number of stitches, the linear speed of the yarn, and the rpm of the knitting machine.

BRIEF DESCRIPTION OF THE DRAWING

These and other objects of the invention and a better understanding thereof may be derived from the following description and the accompanying drawing, in which The drawing is a schematic diagram of the preferred form of monitor.

DETAILED DESCRIPTION OF THE PREFERRED EMBODIMENT

As shown in the drawing, the preferred form of monitor unit includes a yarn-sensor circuit Y, a needle-detector circuit N, a timer circuit T, a selector switch S, and a display D. The several components are mounted in any suitable casing for transport between knitting machines.

The yarn-sensor circuit Y includes a suitable yarn-engaging unit 10 which emits a fixed number of pulses per unit length of the travelling yarn it engages. The yarn-engaging unit 10 may be of any of several types, as may be desired. Most conveniently, the unit 10 includes a pulley 11, which is simply presented against the running yarn. The pulley has a reflective face carrying two diametrically-opposed, non-reflective black marks. Light from a bulb and reflected toward a photodiode (not shown) thus provides two pulses for each revolution of the pulley. The pulses from the unit 10 are supplied, via a suitable amplifier 14, to a divider 15.

Ideally, the pulley circumference engaging the yarn is 33.333 mm, so that three revolutions of the pulley (over a 100 mm length of the yarn) will provide 6 pulses per meter of yarn. This pulse rate per unit of yarn length is especially advantageous, as will be discussed hereinafter regarding operation of the monitor unit.

The divider 15 is connected to a contract *y*1 in the switch assembly S. A branch line 16 bypasses the divider 15 and is connected to a contact *y*2 in the switch.

The needle-detector circuit N includes a detector 17 which emits pulses, via a suitable amplifier 18, to a selective counter 19. Preferably, the detector 17 is a tunable stroboscope or a suitable optoelectronic unit employing fiber optics and avoiding contact with the needles.

The counter 19 is connected to two contacts *n*1 and *n*3 in the switch assembly S. Preferably, the counter is set for 100, with one pulse being emitted for each needle, or a duration of 100 needles if the pulse rate is other than one per needle.

The timer circuit T includes a time signal generator 20, preferably of the quartz crystal type, and a divider 21 to provide a signal duration of one second at contacts *t*2 and *t*3 in the switch assembly S.

The switch assembly S includes a moveable arm 22 carrying a pair of contacts 23 and 24 in communication with a gate 25. The output of the gate 25 is supplied to the numerical display unit D.

OPERATION OF THE PREFERRED EMBODIMENT

When it is desired to compare the yarn length consumed to the selected number of stitches, the switch is positioned as shown in the drawing with contact 23 closing on contact *y* 1 and gate-control contact 24 closing on contact *n*1. The monitor is then presented to the machine to be monitored, with the pulley 11 in driving contact with the yarn and the needle detector 17 associated with the needle bank. Yarn pulses are then delivered via the amplifier 14, divider 15 and the gate 25 for the duration of 100 stitches, as gauged by the passage of 100 needles.

The needle pulses are delivered via the amplifier to the counter, which is set to hold the gate 25 open for that count. Upon closing of the gate 25, the total displayed on the display unit may be read directly as millimeters per 100 stitches, in view of the 33.333 mm pulley, the two pulses per rpm and the "6" divider 15. Other ratios may be provided, however, if it is desired.

However, the preferred relationship is of advantage when it is desired to monitor the linear yarn speed alone. The switch is then moved to engage contacts *y*2 and *t*2, to provide yarn pulses through the gate under control of the signal of the frequency meter and divider via contacts *t*2 and 24.

Since the pulley makes three revolutions per meter of yarn, a yarn speed of 100 meters/mm will provide 6000 pulses per minute to the branch line 16 and the contact *y*2 and 23 to he gate and counter display D. With the frequency meter circuit set for a duration of one second, the yarn speed is then directly displayed in meters/min.

When it is desired to determine the rotary speed of the knitting machine, the switch is moved to close with contacts *n*3 and *t*3. With the stroboscope tuned to the rate of passage of the needles and the frequency meter duration remaining at one second, the rpm of the machine may be calculated with the formula:

$$\text{rpm} = \frac{\text{display number} \times 60}{\text{total needles in machine}}$$

The duration of the count, as governed by the frequency meter, may be selected for a period other than 1 second. The formula would then require a corresonding adjustment.

Therefore, it is apparent that the present invention provides a particularly advantageous monitor unit which is both portable and versatile and which will provide a full operating check of several machines in succession. This is accomplished without the need for complication of each of the several knitting machines with components useful only for the monitoring procedure.

Various changes may be made in the details of the invention, as disclosed, without sacrificing the advantages thereof or departing from the scope of the appended claims.

I claim:

1. A portable monitor unit for knitting machines including;

yarn sensor means for emitting a fixed number of pulses per unit of length of yarn, a needle detector circuit including a stroboscopic element for sensing a needle of the knitting machine and a counter for counting cycles of the needle and emitting pulses according to the cycle count, a frequency meter, a numerical display unit and switch means, including gate means, for selectively supplying pulses to said numerical display unit from a selected one of said yarn sensor means and said needle detector circuit for an interval determined by the gate means according to a selected one of said counter of the needle detector circuit and said frequency meter.

2. The portable monitor unit of claim 1 in which the yarn sensor means includes means for emitting six pulses per meter of yarn and includes a divider connectable to said display unit by said switch means when said gate means is connected with the counter of the needle detector circuit.

3. The portable monitor unit of claim 1 in which the yarn sensor means includes a divider and a branch contact bypassing said divider and connectable to said display unit by said switch means when said gate means is connected with the frequency meter.

4. The portable monitor unit of claim 1 in which said yarn sensor means includes a pulley engageable with the yarn.

5. The portable monitor unit of claim 1 in which the frequencymeter is riven by a quartz crystal.

* * * * *